US006766543B1

(12) United States Patent
Hollis et al.

(10) Patent No.: US 6,766,543 B1
(45) Date of Patent: Jul. 27, 2004

(54) BATHING APPARATUS

(75) Inventors: Steve Hollis, Blair, NE (US); Bryan Johnson, Cokato, MN (US); Jim Novotne, Columbus, NE (US); Gary Albers, Phillips, NE (US); Jay Groelz, Phillips, NE (US)

(73) Assignee: MasterCare Patient Equipment, INC, Columbus, NE (US)

( * ) Notice: Subject to any disclaimer, the term of this patent is extended or adjusted under 35 U.S.C. 154(b) by 56 days.

(21) Appl. No.: 10/252,677

(22) Filed: Sep. 23, 2002

Related U.S. Application Data

(60) Provisional application No. 60/325,266, filed on Sep. 27, 2001.

(51) Int. Cl.[7] ..... A47K 3/02

(52) U.S. Cl. ..... 4/555; 4/556; 4/578.1; 4/604

(58) Field of Search ..... 4/555, 556, 560.1, 4/571.1, 578.1, 579, 604

(56) References Cited

U.S. PATENT DOCUMENTS

| | | | | |
|---|---|---|---|---|
| 746,390 A | | 12/1903 | Schmidt | |
| 2,991,482 A | | 1/1961 | Brass | |
| 3,371,354 A | | 3/1968 | Hayslett | |
| 3,380,076 A | | 4/1968 | Hanson | |
| 3,662,409 A | | 5/1972 | Johansson | |
| 3,663,971 A | | 5/1972 | Bonhote | |
| 3,719,960 A | | 3/1973 | Russell | |
| 3,863,275 A | | 2/1975 | Brengord et al. | |
| 4,118,810 A | | 10/1978 | Brickhouse et al. | |
| 4,583,251 A | | 4/1986 | Karl et al. | |
| D285,346 S | | 8/1986 | Sween | |
| 5,255,400 A | | 10/1993 | Sween | |
| 5,393,119 A | * | 2/1995 | Mukai | 297/217.1 |

FOREIGN PATENT DOCUMENTS

| | | | | |
|---|---|---|---|---|
| GB | 1 582 900 | | 1/1981 | |
| JP | 9-19475 | * | 1/1997 | A61H/33/00 |
| JP | 2000-116745 A | * | 4/2000 | A61H/33/00 |

OTHER PUBLICATIONS

Sales Literature of Silcraft Corporation, of Acme, Michigan, for "The Bather" exact publication date unknown, but at least one year prior to the filing of the present application.
Sales Literature of Century Manufacturing Company of Aurora, Nebraska, for "Patient Bathing System", exact publication date unknown, but at least one year prior to the filing of the present application.
510(k) Premarket Notification to the Food and Drug Administration of Aqua Care Corporation of North Mankato, MN, believed to have been published on or before Oct. 10, 1980.

* cited by examiner

*Primary Examiner*—Tuan N. Nguyen
(74) *Attorney, Agent, or Firm*—Erickson & Kleypas, L.L.C.

(57) ABSTRACT

A bathing apparatus comprises a bathtub having a wall with an opening formed therein and a door panel sized and shaped to conform to the opening. The door panel is movably connected to the wall by a hinge mechanism which includes a substantially horizontal bar having a first end pivotally connected to the wall adjacent to the door opening and a substantially vertical slide rail secured to the bar. A slide bracket secured to the door panel is slidably mounted on the slide rail. The bathing apparatus further includes a chair with a seat portion that is removably attached to a base portion and receivable within the bathtub. The chair includes a pair of armrests, one of which is attached to the chair portion and one of which is attached to the base portion.

26 Claims, 6 Drawing Sheets

BATHING APPARATUS

This application claims the benefit of copending provisional application, Ser. No. 60/325,266, filed Sep. 27, 2001 and entitled FRONT ENTRY BATHING TUB WITH CHAIR TRANSFER SYSTEM.

BACKGROUND OF THE INVENTION

1. Field of the Invention

The present invention relates generally to front entry bathtubs, and more particularly to an improved entry door for a bathtub and an incorporated chair transfer apparatus.

2. Description of the Related Art

Front entry bathtubs are generally used for bathing persons who are not physically capable of entering and exiting a standard bathtub. These tubs include a door opening formed in a tub wall through which the person may enter the tub without climbing over the wall. The tub must also include a door panel for closing and sealing the door opening so that bath water will not leak out of the tub. The door panel is typically larger than the associated door opening in the tub wall and is designed to seal against an inner surface of the tub wall so that water pressure inside the tub acts to seal the door rather than acting against the seal. The door panel, however, must be swung outwardly through the door opening to permit a person to easily enter and exit the tub. This presents a design difficulty because it requires the door panel to swing through a door opening that is smaller than the door panel itself.

One door mechanism for a front entry bathtub is disclosed by U.S. Pat. No. 5,255,400 to Adrian R. Sween, which is entitled Apparatus for Containing a Liquid. The door panel of the Sween '400 tub is mounted on a parallelogram linkage which allows it to be moved vertically relative to the tub. A first end of the parallelogram linkage is pivotally attached to the tub adjacent to the door opening so that the door panel may be swung outwardly. A second end of the parallelogram linkage is pivotally attached to the door panel so that the door panel may be canted at an angle as it is pulled through the door opening.

SUMMARY OF THE INVENTION

The present invention comprises a bathing apparatus which includes a bathtub having a wall with a door opening formed therethrough. The door opening has an upper dimension along the top edge of the wall and a lower dimension spaced downwardly from the top edge of the wall, the lower dimension being smaller than the upper dimension. A door panel sized and shaped to conform to the door opening is moveably connected to the bathtub by a hinge mechanism. The door panel has a sealing flange extending outwardly therefrom for engaging with a portion of the inner surface of the wall adjacent the door opening. The hinge mechanism includes a substantially horizontal bar having a first end pivotally connected to the wall adjacent to the door opening and a substantially vertical slide rail secured to the bar. One or more slide brackets are secured to the door panel and slidably mounted on the slide rail. The door panel is thus vertically moveable by sliding the slide brackets along the slide rail and moveable toward and away from the tub wall by pivoting the bar about its mounting point. The hinge mechanism may further include a gas strut which assists in lifting the door panel by urging it into an upward position and a door latch which selectively holds the door panel in a lowered or closed position.

The bathing apparatus further includes a chair transport apparatus including a chair with a seat portion that is removably attached to a base portion. The bathtub includes a pair of tub rails which slidably receive the seat portion of the chair when it is released from the base portion. The chair includes a pair of armrests, one of which is attached to the chair portion and one of which is attached to the base portion.

DETAILED DESCRIPTION OF THE PREFERRED EMBODIMENT

Figure 1:
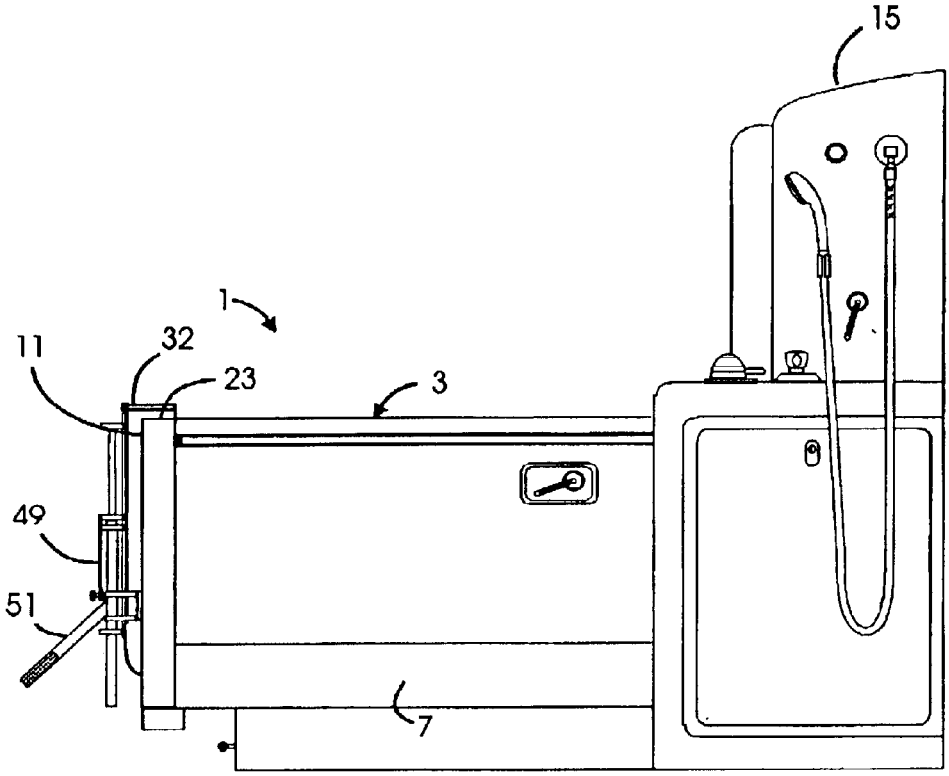
FIG. 1 is a right side elevational view of a bathing apparatus embodying the present invention.
Figure 2:
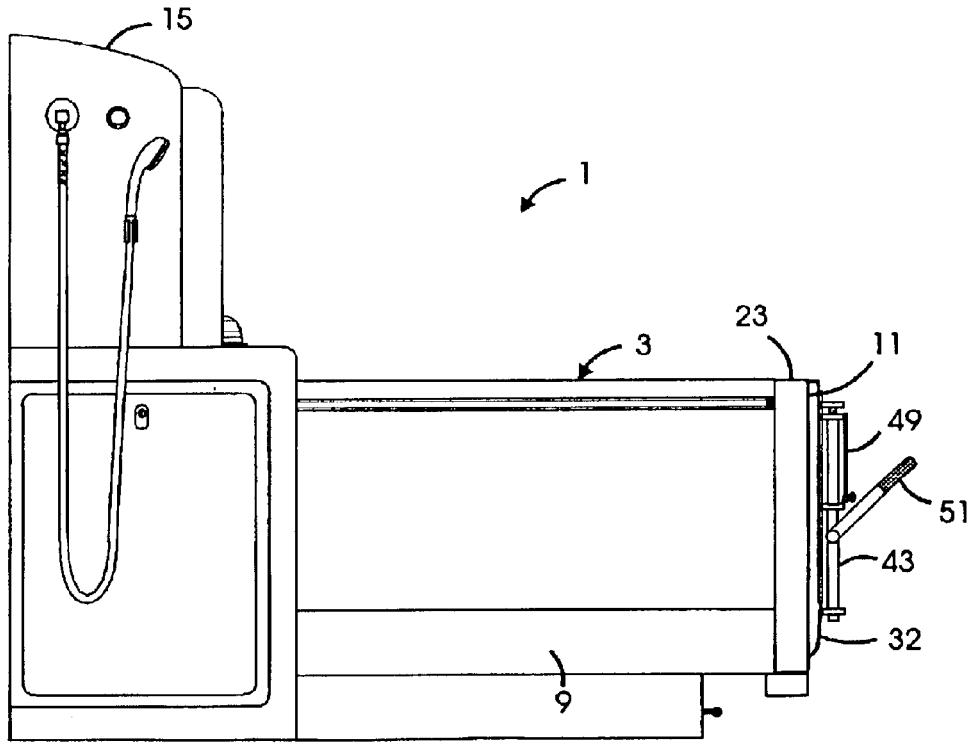
FIG. 2 is a left side elevational view of the bathing apparatus.
Figure 3:
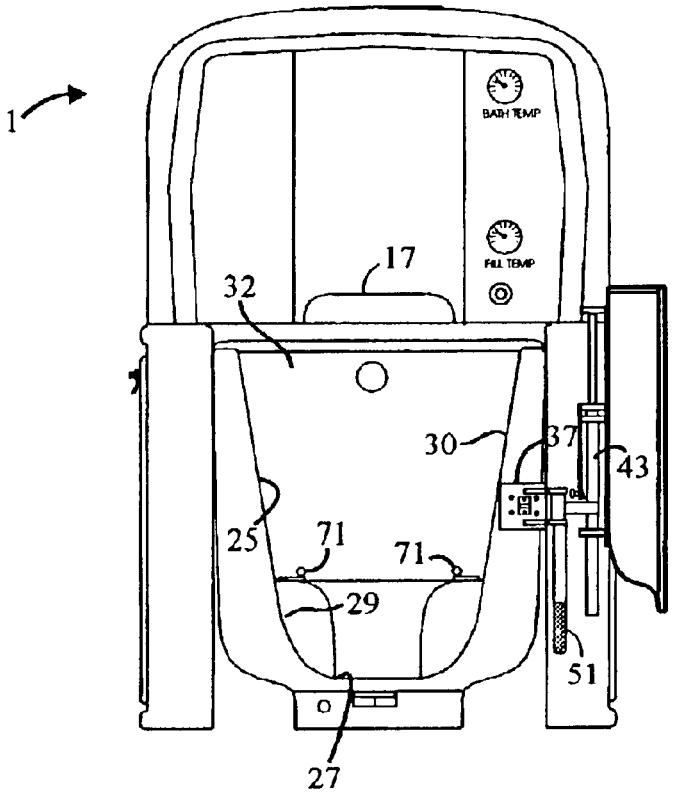
FIG. 3 is a front elevational view of the bathing apparatus, with the front door thereof open.
Figure 4:
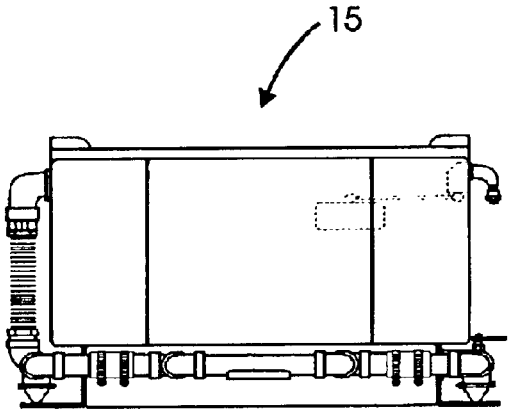
FIG. 4 is a detailed elevational view of the bath reservoir of the bathing apparatus.
Figure 5:
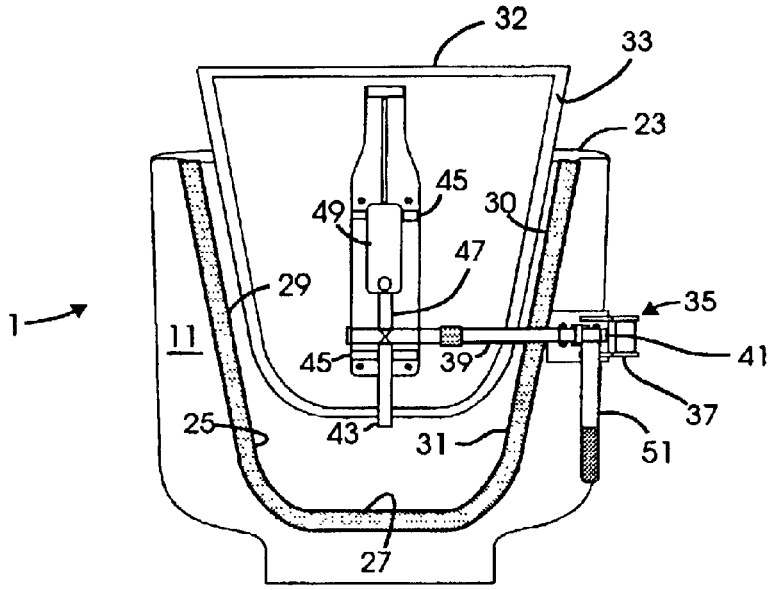
FIG. 5 is a front elevational view of the bathtub of the bathing apparatus showing the operable front door thereof moved upwardly out of a sealed condition with the bathtub.
Figure 6:
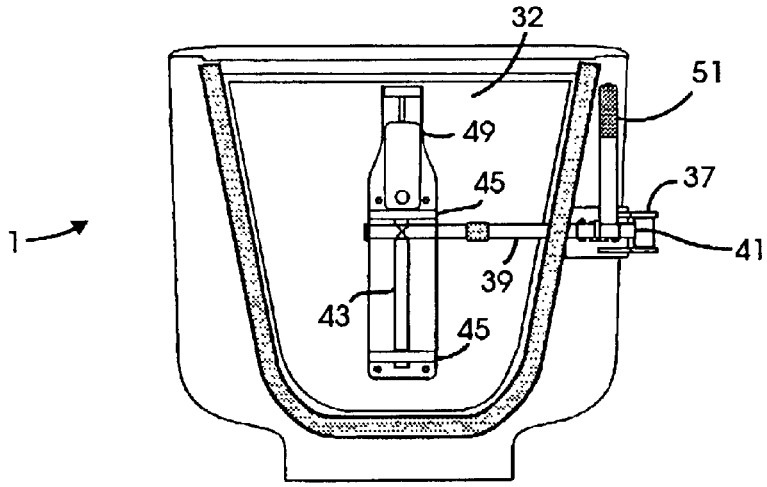
FIG. 6 is a view similar to FIG. 5, but with the door lowered and sealed in position.
Figure 7:
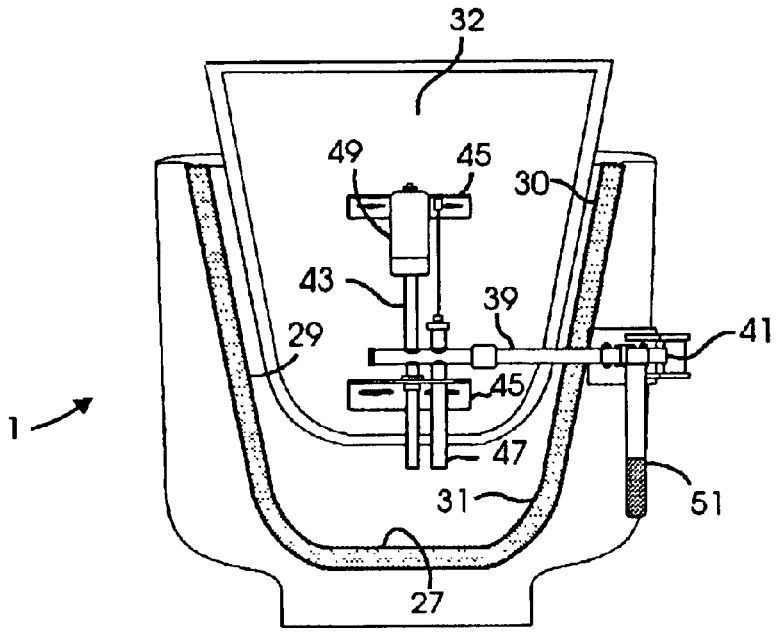
FIG. 7 is a view similar to FIG. 5 showing an alternative embodiment of the door.
Figure 8:
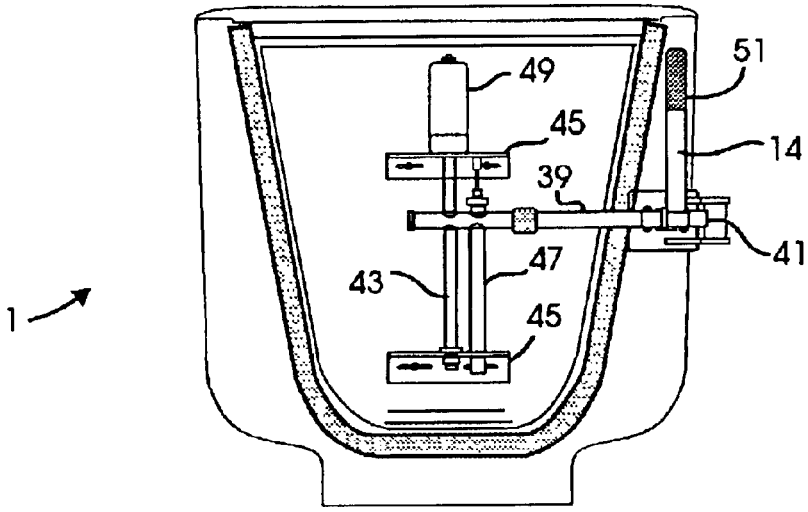
FIG. 8 is a view similar to FIG. 6 showing the embodiment of FIG. 7 in the closed and sealed position.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, and in particular to FIGS. 1–3 and 11, the reference number 1 generally designates a bathing apparatus embodying the present invention. The bathing apparatus 1 includes a bathtub 3 having a floor 5, sidewalls 7 and 9, an entry end wall 11 and a fill end wall 13. The entry end wall 11 has an inner surface 19, an exterior surface 21 and an upper edge 23. Positioned above the bathtub 3 proximate the fill end wall 13 is a reservoir 15 having a spigot 17 for filling the bathtub 3 with water.

Referring to FIGS. 5–8, the entry end wall 11 further includes a door opening 25 through which a person may enter or exit the bathtub 3. The door opening 25 has a truncated V-shape and includes a threshold 27 and sides 29 and 30 which slope inwardly from the upper edge 23 of the entry end wall 11 to the threshold 27. The upper dimension of the door opening 25 proximate the upper edge 23 of the entry end wall 11 is thus greater than the lower dimension proximate the threshold 27. An elastomeric seal 31 is mounted on the inner surface 19 of the entry end wall 11 adjacent to the door opening 25.

The door opening 25 is selectively covered by a door panel 32 moveable into sealing engagement with the interior surface 19 of the entry end wall 11 through the seal 31. The door panel 32 is sized and shaped to cover the door opening 25 and includes an outwardly extending flange 33 which is engageable with the seal 31.

The door panel 32 is moveably mounted on the bathtub 3 by a door hinge and latch mechanism 35 which includes a mounting bracket 37 secured to the exterior surface 21 of the entry end wall 11 adjacent to the door opening 25. A generally horizontal bar 39 has a proximate end 41 which is pivotally connected to the mounting bracket 37 such that the bar 39 is moveable toward and away from the entry end wall 11 of the bathtub 3. Fixedly attached to the bar 39 is a generally vertical slide rail 43. One or more slide brackets 45 are secured to the door panel 32 and slidably engage the slide rail 43. The door panel 32 is thus vertically moveable by virtue of the slide brackets 45 moving along the slide rail 43.

In order to assist in raising the door panel 32, the door hinge and latch mechanism 35 preferably includes a gas strut 47 which acts to urge the door panel upwardly. In a first embodiment of the mechanism 35 shown in FIGS. 5 and 6, a gas strut 47 is mounted to the horizontal bar 39 such that the cylinder of the strut 47 serves as the slide rail 43 along which the slide brackets 45 move. The rod end of the strut 47 engages or is connected to the door panel 32 and acts to urge the door panel 32 upwardly. In a second embodiment, in FIGS. 7 and 8, the strut 47 is mounted to the bar 39 parallel to the slide rail 43. Again, the rod end of the strut 47 is secured to or engages the door panel 32 so as to urge the door panel upwardly.

Each of the embodiments disclosed includes a door latch 49 which acts to latch the door panel 32 in a lowered position against the action of the strut 47. The door latch 49 is shown as being secured to the slide rail 43 and selectively engaging one of the slide brackets 45 to retain the door panel 32 in its lowered position. The latch 49 locks in place automatically when the door panel 32 is pushed downwardly.

The door hinge and latch mechanism 35 further includes a sealing latch handle 51 which is rotatably mounted about the horizontal bar 39 proximate the mounting bracket 37. The sealing latch handle 51 is moveable from a downwardly extending position to an upwardly extending position. Moving the handle 51 from the downwardly extending position to the upwardly extending position draws the door panel 32 toward the seal 31 to seal the joint between the door panel 32 and the entry end wall 11.

To open the door panel 32, the sealing latch handle is first moved from the upwardly extending position to the downwardly extending position to unseal the door. The door latch 49 is then released, allowing the gas strut 47 to raise the door panel 32. Once the door panel 32 is raised, it is free to swing outwardly through the door opening 25 by pivoting the horizontal bar 39 about its connection to the bracket 37. With the door panel 32 swung outwardly, a person may enter the bathtub 3 through the door opening 25.

To close the door panel 32, the process previously described is reversed. The door panel 32 is first swung into the bathtub 3 through the door opening 25 by pivoting the bar 39 about its connection to the bracket 37. The door panel 32 is then pushed downwardly against the bias of the gas strut 47 until the door latch 49 catches. Finally, the door is sealed by moving the the sealing latch handle 51 from the downwardly extending position to the upwardly extending position.

Figure 9:
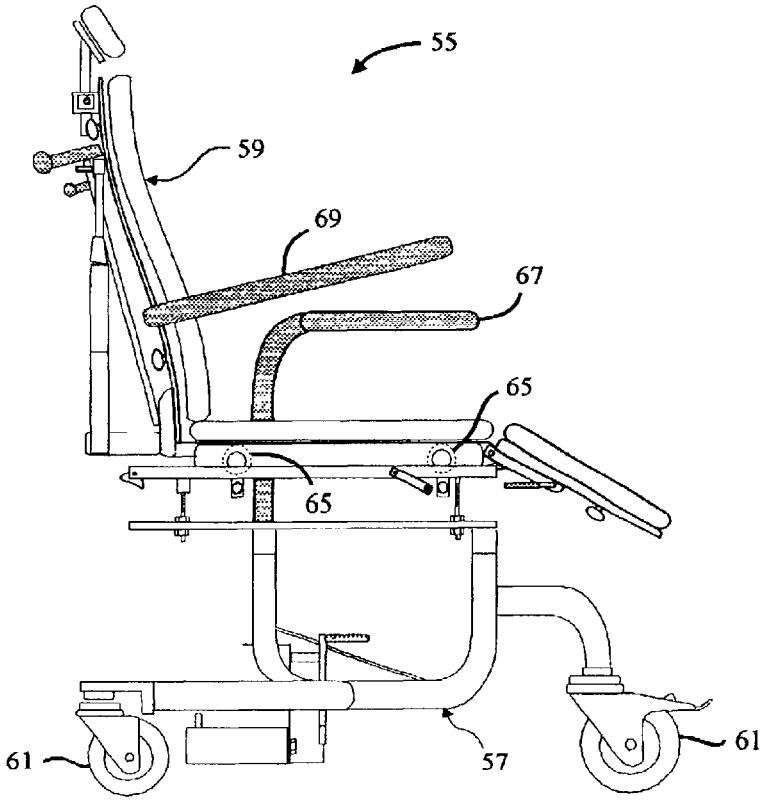
FIG. 9 is a side elevational view of the chair transfer apparatus of the bathing apparatus.
Figure 10:
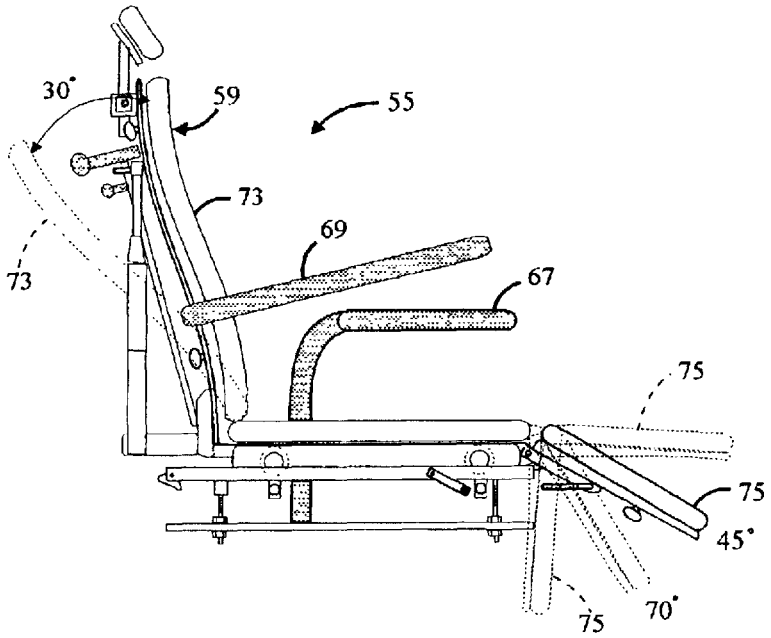
FIG. 10 is a side elevational view of the major features of the chair transfer apparatus of FIG. 9 showing range of adjustment of the leg and back rests.
Figure 11:
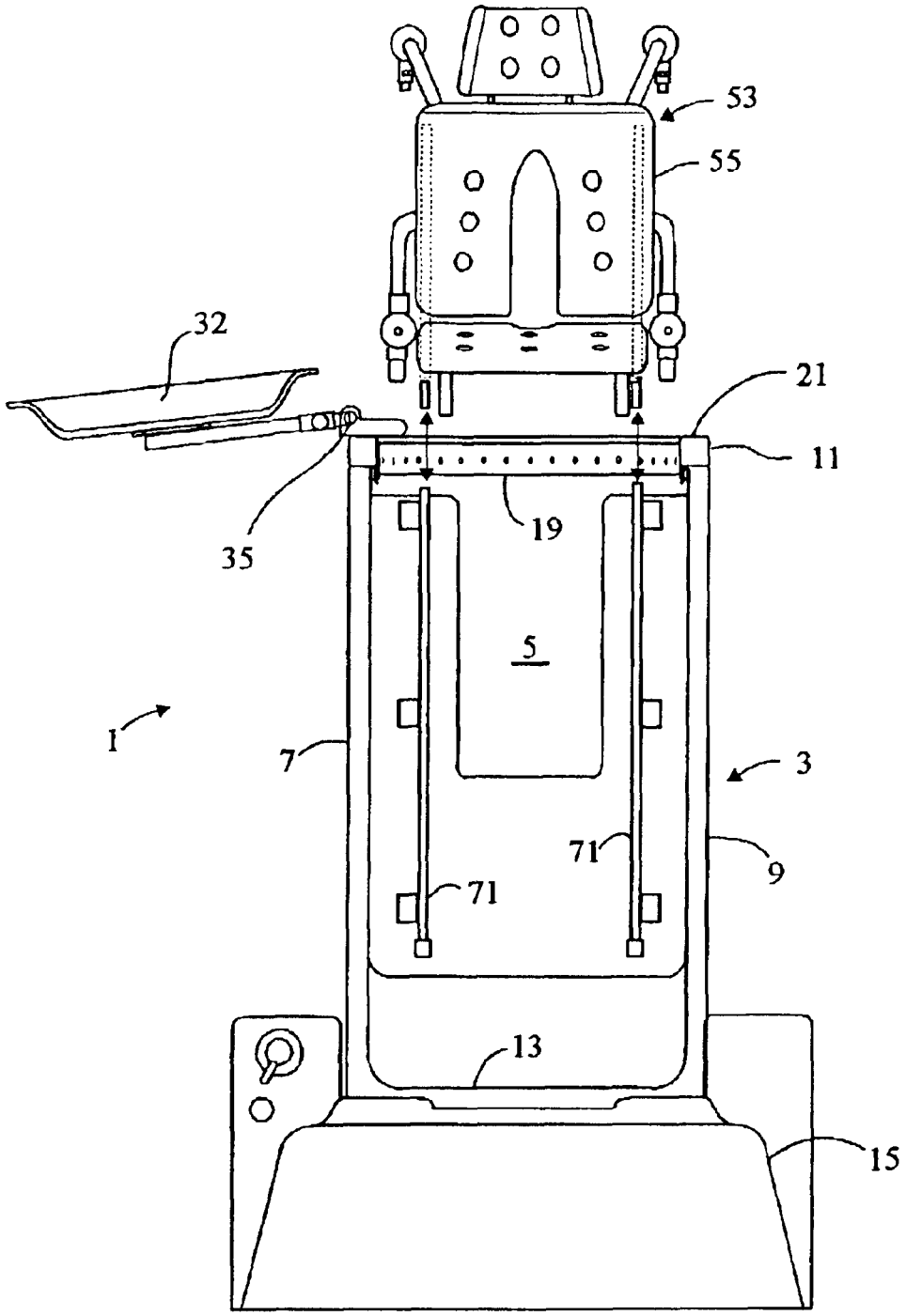
FIG. 11 is a top plan view of the bathing apparatus showing the carrier rails of the chair transfer apparatus.

Referring to FIGS. 9–11, the bathing apparatus 1 further includes a chair transfer apparatus 53 for use by an attendant in moving an invalid person into and out of the bathtub 3. The transfer apparatus includes a chair 55 having a base portion or carrier 57 and a seat portion 59 which is removably attached to the base portion 57. The base portion 57 includes wheels 61 which allow the chair 55 and a person seated therein to be rolled into a position adjacent the door opening 25. The base portion 57 further includes a pair of chair rails which are rollingly engaged by rollers 65 on the seat portion 59. A chair release mechanism (not shown) selectively retains the seat portion in position relative to the base portion. The chair 55 includes a pair of arm rests, including a carrier arm rest 67 which is secured to the base portion 57 of the chair and a seat arm rest 69 which is secured to the seat portion of the chair.

The chair transfer apparatus further includes a pair of tub rails 71 which are mounted inside the bathtub 3. The tub rails 71 align with the chair rails on the base portion 57 of the chair 55 such that the seat portion 59 may be released from the base portion 57 and rolled off of the chair rails and directly onto the tub rails 71, placing a person seated on the seat portion 59 inside the bathtub 3. The seat arm rest 69 goes with the seat portion 59 for use by the person being bathed. The carrier arm rest 67 remains with the base portion 57 of the chair 55 and thereby serves as a handle by which the attendant may move the base portion 57.

As seen in FIG. 10, the seat portion 59 of the chair 55 includes a reclinable back rest 73 and an adjustable leg rest 75. The back rest 73 allows the person being bathed to lean backward up to thirty degrees, while the leg rest 73 may be adjusted to support the person's legs in any position up to horizontal.

Once the person is inside the bathtub 3, the door panel 32 is closed as previously described, and water is drained from the reservoir 15 into the bathtub 3 to bath the person.

It is to be understood that while certain forms of the present invention have been illustrated and described herein, it is not to be limited to the specific forms or arrangement of parts described and shown.

What is claimed and desired to be secured by Letters Patent is as follows:

1. A bathing apparatus comprising:

a) a bathtub having a wall with inner and outer surfaces and a top edge and a door opening formed in said wall, said door opening having an upper dimension along the top edge of said wall and a lower dimension spaced downwardly from said top edge of said wall, said lower dimension being smaller than said upper dimension;

b) a door panel sized and shaped to conform to said door opening and having a sealing flange extending outwardly therefrom, said sealing flange being engageable with a portion of the inner surface of said wall adjacent said door opening; and c) a hinge mechanism; comprising:

i) a substantially horizontal bar having a first end pivotally connected to said wall adjacent to said door opening;

ii) a substantially vertical slide rail secured to said bar; and iii) a slide bracket secured to said door panel and slidably mounted on said slide rail.

2. The bathing apparatus as in claim 1 and further including a gas strut connected to said bar and acting on said door panel to urge said door panel upwardly.

3. The bathing apparatus as in claim 2 and further including a latch connected to said slide rail and engageable with said slide bracket to retain said door in a lowered position.

4. The bathing apparatus as in claim 2 wherein an outer portion of said gas strut acts as said slide rail.

5. The bathing apparatus as in claim 1 and further including an elastomeric sealing member positioned intermediate said inner surface of said wall and said sealing flange of said door panel.

6. The bathing apparatus as in claim 1 and further including a chair transfer apparatus, comprising:

a) a chair having a seat portion releasably attached to a base portion and first and second armrests, said first armrest being connected to said seat portion and said second armrest being connected to said base portion; and b) means for slidably receiving said seat portion of said chair through said door opening when said seat portion is released from said base portion.

7. The bathing apparatus as in claim 6 wherein said seat portion includes a reclinable back.

8. The bathing apparatus as in claim 6 wherein said seat portion includes an adjustable leg rest.

9. The bathing apparatus as in claim 8 wherein said leg rest is moveable between a retracted position and a generally horizontal extended position.

10. A bathing apparatus comprising:

a) a bathtub having a wall with inner and outer surfaces and a top edge and a door opening formed in said wall, said door opening having an upper dimension along the top edge of said wall and a lower dimension spaced downwardly from said top edge of said wall, said lower dimension being smaller than said upper dimension;

b) a door panel sized and shaped to conform to said door opening and having a sealing flange extending outwardly therefrom, said sealing flange being engageable with a portion of the inner surface of said wall adjacent said door opening; and c) a hinge mechanism; comprising:

i) a substantially horizontal bar having a first end pivotally connected to said wall adjacent to said door opening;

ii) a substantially vertical gas strut having a cylinder secured to said bar and a rod end engaging said door panel so as to urge said door panel upwardly; and iii) a slide bracket secured to said door panel and slidably mounted on said cylinder of said gas strut.

11. The bathing apparatus as in claim 10 and further including a latch connected to said slide rail and engageable with said slide bracket to retain said door in a lowered position.

12. The bathing apparatus as in claim 10 and further including an elastomeric sealing member positioned intermediate said inner surface of said wall and said sealing flange of said door panel.

13. The bathing apparatus as in claim 10 and further including a chair transfer apparatus, comprising:

a) a chair having a seat portion releasably attached to a base portion and first and second armrests, said first armrest being connected to said seat portion and said second armrest being connected to said base portion; and b) means for slidably receiving said seat portion of said chair through said door opening when said seat portion is released from said base portion.

14. The bathing apparatus as in claim 13 wherein said seat portion includes a reclinable back.

15. The bathing apparatus as in claim 13 wherein said seat portion includes an adjustable leg rest.

16. The bathing apparatus as in claim 15 wherein said leg rest is moveable between a retracted position and a generally horizontal extended position.

17. A bathing apparatus comprising:

a) a bathtub having a wall, a door opening formed in said wall and a door panel selectively covering said opening; and b) a chair transfer apparatus, comprising:

i) a chair having a seat portion releasably attached to a base portion and first and second armrests, said first armrest being connected to said seat portion and said second armrest being connected to said base portion; and ii) means for slidably receiving said seat portion of said chair through said door opening when said seat portion is released from said base portion.

18. The bathing apparatus as in claim 17 wherein said door panel is moveably connected to said bathtub by a hinge mechanism; comprising:

a) a substantially horizontal bar having a first end pivotally connected to said wall adjacent to said door opening;

b) a substantially vertical slide rail secured to said bar; and c) a slide bracket secured to said door panel and slidably mounted on said slide rail.

19. The bathing apparatus as in claim 18 and further including a gas strut connected to said bar and acting on said door panel to urge said door panel upwardly.

20. The bathing apparatus as in claim 19 and further including a latch connected to said slide rail and engageable with said slide bracket to retain said door in a lowered position.

21. The bathing apparatus as in claim 19 wherein an outer portion of said gas strut acts as said slide rail.

22. The bathing apparatus as in claim 17 wherein said door panel is moveably connected to said bathtub by a hinge mechanism; comprising:

a) a substantially horizontal bar having a first end pivotally connected to said wall adjacent to said door opening;

b) a substantially vertical gas strut having a cylinder secured to said bar and a rod end engaging said door panel so as to urge said door panel upwardly; and c) a slide bracket secured to said door panel and slidably mounted on said cylinder of said gas strut.

23. The bathing apparatus as in claim 22 and further including a latch connected to said slide rail and engageable with said slide bracket to retain said door in a lowered position.

24. The bathing apparatus as in claim 17 wherein said seat portion includes a reclinable back.

25. The bathing apparatus as in claim 17 wherein said seat portion includes an adjustable leg rest.

26. The bathing apparatus as in claim 23 wherein said leg rest is moveable between a retracted position and a generally horizontal extended position.

* * * * *